United States Patent [19]

Greene

[11] Patent Number: 4,473,485

[45] Date of Patent: Sep. 25, 1984

[54] FREE-FLOWING DETERGENT POWDERS

[75] Inventor: Alan P. Greene, Edison, N.J.

[73] Assignee: Lever Brothers Company, New York, N.Y.

[21] Appl. No.: 439,459

[22] Filed: Nov. 5, 1982

[51] Int. Cl.[3] ..... C11D 17/06; C11D 1/66; C11D 3/10

[52] U.S. Cl. ..... 252/174.12; 252/89.1; 252/174.24; 252/DIG. 1; 252/DIG. 2

[58] Field of Search ..... 252/89.1, 546, 174.24, 252/DIG. 1, DIG. 2

[56] References Cited

U.S. PATENT DOCUMENTS

| | | | |
|---|---|---|---|
| 3,655,568 | 4/1972 | Zaki et al. | 252/99 |
| 3,714,051 | 1/1973 | Milesi et al. | 252/135 |
| 3,799,880 | 3/1974 | Kelly et al. | 252/174.24 X |
| 3,850,852 | 11/1974 | Neillie et al. | 252/536 |
| 3,868,336 | 2/1975 | Mazzola et al. | 252/527 |
| 3,915,878 | 10/1975 | Yurko et al. | 252/89 |
| 3,957,695 | 5/1976 | Davies et al. | 252/135 X |
| 3,979,314 | 9/1976 | Child | 252/174.25 X |
| 3,992,314 | 11/1976 | Cherney | 252/160 |
| 4,000,080 | 12/1976 | Bartolotia et al. | 252/99 |
| 4,013,578 | 3/1977 | Child et al. | 252/174.25 X |
| 4,022,702 | 5/1977 | Curtis | 252/174.14 |
| 4,028,262 | 6/1977 | Cheng | 252/89 |
| 4,051,054 | 9/1977 | Davies et al. | 252/174.12 X |
| 4,059,538 | 11/1977 | Green et al. | 252/95 |
| 4,076,653 | 2/1978 | Davies et al. | 252/174.25 X |

FOREIGN PATENT DOCUMENTS

| | | |
|---|---|---|
| 1415301 | 11/1975 | United Kingdom . |
| 2029854 | 3/1980 | United Kingdom . |

*Primary Examiner*—John E. Kittle
*Assistant Examiner*—Mukund J. Shah
*Attorney, Agent, or Firm*—Milton L. Honig; James J. Farrell

[57] ABSTRACT

A free-flowing granular laundry detergent composition and a process for preparing it is disclosed. The composition employs:

(a) a polycarboxylic structuring agent;

(b) a finely divided alkali or alkaline earth metal carbonate having a particle diameter of 20 microns or less; and (c) a nonionic surfactant.

The process includes mixing (a) and (b) prior to adding (c) and subsequently aqueously dispersing and mixing all the components followed by removal of excess water.

26 Claims, No Drawings

FREE-FLOWING DETERGENT POWDERS

BACKGROUND OF THE INVENTION

1. Field of the Invention

The present invention concerns a free-flowing heavy duty granular laundry detergent composition containing high levels of nonionic surfactant and describes a process for manufacturing these materials.

2. The Prior Art

Most granular detergents are produced by spray drying. This process involves slurrying of detergent components and spray atomization in a high temperature air stream. Volatile materials, such as nonionic surfactants, are emitted into the air when processed by this method with the other detergent components. This volatilization problem, manifested by discharge of dense "blue" smoke from the spray tower, is referred to as "pluming". Air pollution standards limit the opacity of the plume. Consequently, it is necessary to limit the capacity of the spray tower, or in extreme instances, discontinue operation.

Inclusion of the nonionic surfactants in the spray dry process also is hazardous. Increased incidences of fire and explosion result. Auto-oxidation or process upset are blamed for such occurrences.

In an attempt to avoid the problems caused by spray drying, considerable developmental effort has focused on post-dosing. In post-dosing, the nonionic surfactant is added to the product after the spray drying operation. Usually, this method works well only for surfactants that are normally solid. Yet, it is the liquid and semi-liquid nonionics whose inclusion is more desirable in detergent compositions. Post-dosing of spray dried base with liquid or semi-liquid surfactant, in amounts sufficient to provide satisfactory wash performance, generally, results in poor flowing aesthetically displeasing products. Accordingly, the amount of liquid and semi-solid surfactant that may be employed in the detergent formulation is severely limited. This limitation is disadvantageous, since, for heavy duty laundry detergents, it is desirable to have large amounts of nonionic surfactant present.

In an attempt to solve this problem, inorganic silicates have been formulated with the spray dried powders to absorb the nonionic liquids. However, an extreme dust explosion hazard exists with these formulations. Further, the silicate method is usually only useful for low and moderate loadings of nonionic surfactant. At higher levels, product crispness and compaction deteriorate. Moreover, these silicates only function as process aids; they have no significant cleaning activity.

Therefore, a need exists for a composition which substantially overcomes the problem of free-flowability in highly loaded nonionic detergents while decreasing the attendant fire, explosion and pollution hazards.

SUMMARY OF THE INVENTION

It has now been discovered that free-flowing detergent powders containing a high level of nonionic surfactant can be formulated as described below.

A free-flowing detergent composition comprising:

(a) a polycarboxylic structuring agent present in about 0.2% to about 50% by weight of final product;

(b) a finely divided alkali or alkaline earth metal carbonate or mixtures thereof present in about 1% to about 80% by weight of final product, and having a mean particle diameter of 20 microns or less; and (c) a nonionic surfactant present in about 1% to about 50% by weight of the final product.

Further, a process for manufacturing a free-flowing powdered detergent composition has been discovered comprising:

(i) thoroughly mixing (a) a polycarboxylic structuring agent present in about 0.2% to about 50% by weight of final product;

(b) a finely divided alkali or alkaline earth metal carbonate and mixtures thereof present in about 1% to about 80% by weight of final product, and having a mean particle diameter of 20 microns or less; and (c) a detergent builder present in about 1% to about 98.8% by weight of final product;

(ii) subsequently applying to said mixture about 1% to about 50% of a nonionic surfactant and about 4% to about 30% of water for dispersal of the structuring agent and mixing together the total combination; and thereafter (iii) removing excess water.

DETAILED DESCRIPTION OF THE INVENTION

A chemical combination for detergents has been discovered that, when used in a wet agglomeration process, can entrap nonionic surfactants within its crystal network. Crisp, free-flowing powders result. Critical features of the invention are the interaction of a polycarboxylic structuring agent with finely divided carbonates, and their dispersion and/or solubilization in water.

Although the present claims are not limited by any theory, two mechanisms of interaction have been suggested. The more significant mechanism is thought to be an encapsulation action. This isolates and binds the nonionic surfactant within the granules. A second suggested mechanism involves an agglomeration effect upon the builder particles. Here, it is thought that solid bridges form which bind the builder particles. These solid bridges encapsulate the nonionic surfactant within the spaces between the particles as larger granules are formed. Once water is removed, the re-solidified carboxylic polymer substantially prevents the nonionic surfactant from reaching the surface of the detergent granules. A crisp free-flowing product results. Scanning electron microscope photographs have captured the various stages of this process.

A number of different polycarboxylic structuring agents may be used in this invention. For purposes of this invention, polycarboxylic structuring agent is defined as an organic substance having at least three carboxylic groups and that can interact with finely divided metal carbonates to either encapsulate or agglomerate nonionic detergent compositions affording free-flowing detergent powders. The polycarboxylic structuring agents may be selected from the group consisting of ethylene-maleic anhydride copolymer, methyl vinyl ether-maleic anhydride copolymer, citric acid, nitrilotriacetic acid, ethylenediamine tetraacetic acid, carboxymethyloxy succinic acid and salts of said copolymers and acids, and mixtures thereof. Both linear and cross-linked copolymers may be utilized.

The polycarboxylic structuring agent may be present in about 0.2% to about 50% by weight of final product. For economic reasons, particularly preferred are the lower concentrations in amounts of about 0.2% to about 5%.

A preferred structuring agent of the present invention is the 1:1 copolymer of ethylene with maleic anhydride. An ethylene-maleic anhydride copolymer having a molecular weight of about 25,000, sold under the trademark "EMA-21" by the Monsanto Company, was found to be a particularly preferred structuring agent. "EMA-24" and "EMA-22", Monsanto Company trademarks for the sodium salt and acid form, respectively, of "EMA-21" were also found to be effective.

Ethylene-maleic anhydride copolymers are made of units having the structural formula

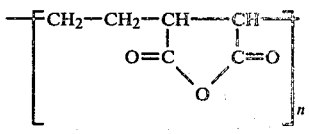

wherein n is an integer of about 100 to about 5000 and having molecular weights of about 10,000 to about 500,000. For reasons of better biodegradability and flow improvement effectiveness, EMA copolymers with molecular weights between 10,000 and 50,000 are particularly preferred.

Copolymers of ethylene-maleic anhydride or of methyl vinyl ether-maleic anhydride may be added to the batch mix as the acid anhydride, the acid or as the neutralized salt of an alkali metal. This addition can be made either as an aqueous, organic or mixed aqueous-/organic solvent solution or as a solid powder. Neutralization of the acid forms may be accomplished before the addition of the polymer to the product. Neutralization may also be done in situ during the batch mixing operation. The in situ method involves dry mixing of acid copolymer with an inorganic base, e.g. sodium carbonate, followed by addition of the liquid (water or solvent). Better dispersal of the copolymer is achieved by this procedure. In situ neutralization is, therefore, preferred. Materials and methods of neutralization are well known. Examples may be found in Technical Bulletin No. IC-FP-7 available from the Monsanto Company. In some instances it may be preferred to pre-neutralize the copolymer. For instance, when the carboxylate is to be employed with aqueous silicate solutions pre-neutralization avoids reaction of the carboxylate with the silicate. A reaction with the silicate would release insoluble silica which may adversely effect solubility of the final product.

In a further embodiment of the invention it has been found that citric acid and its derivatives may be used as the polycarboxylic structuring agents. Citric acid and its salts can be used independently or in combination with other polycarboxylic structuring agents such as the copolymers of ethylene-maleic anhydride and its derivatives. In situ neutralized citric acid is especially beneficial as the structuring agent. It provides a free flowing detergent powder without the necessity of an adjunct structuring agent such as the copolymers of ethylene-maleic anhydride. From the viewpoint of cost it is beneficial to substitute as much citric derivatives for the copolymer type structuring agents as possible. Not only can the citrate be used as the structuring agent in the present invention but it also can be used as a detergent builder. The concentration range for citric acid, sodium citrate, or potassium citrate is about 5% to about 40% by weight of the final product. Cost considerations also dictate that the amount of citric derivative be minimized relative to the inexpensive detergent builders. Therefore, especially preferred are amounts of about 5% to about 15% citrate.

Detergent builder materials whether organic or inorganic may be incorporated into the detergent composition. Typical of the well known inorganic builders are the sodium and potassium salts of the following: pyrophosphate, tripolyphosphate, orthophosphate, carbonate, silicate, sesquicarbonate, borate, and aluminosilicate. Among the organic detergent builders are the sodium and potassium salts of the following: citrate, amino polycarboxylates, nitrilotriacetates, N-(2-hydroxyethyl)-nitrilodiacetates, ethylenediamine tetraacetates, hydroxyethylenediamine tetraacetates, diethylenetriamino pentaacetates, dihydroxyethyl glycine, phytates, polyphosphonates, oxydisuccinates, oxydiacetates, carboxymethyloxysuccinates, hydrofuran tetracarboxylates, esterlinked carboxylate derivatives of polysaccharides such as the sodium and potassium starch maleates, cellulose phthalates, glycogen succinates, semi-cellulose diglycolates, starch, and oxidized heteropolymeric polysaccharides. The foregoing is meant to illustrate but not limit the types of builders that can be employed in the present invention.

Detergent formulations of the present invention may include about 1% to about 98.8% by weight of builder material. For optimal detergent building performance, the builder concentration will vary from about 50% to about 94.5% in the formulations of the present invention.

The nonionic detergent components of this invention can include one or more nonionic surfactant compounds. Suitable nonionic surfactant compounds fall into several different chemical types. These are generally polyoxyethylene or polyoxypropylene condensates of organic compounds having reactive hydrogen atoms. Illustrative but not limiting examples of suitable nonionic compounds are:

(a) Polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acid (derived from coconut oil) which contains an average of about 12 carbon atoms, "tallow" fatty acids (derived from tallow-class fats) which contains an average of about 18 carbon atoms, palmitic acid, myristic acid, stearic acid and lauric acid.

(b) Polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol (derived from coconut oil), "tallow" fatty alcohol (derived from the tallow-class fats), lauryl alcohol, myristyl alcohol, and oleyl alcohol. Particularly preferred nonionic surfactant compounds in this category are the "Neodol" type products, a registered trademark of the Shell Chemical Company. Neodol 23-6.5 and Neodol 25-3 which are, respectively, $C_{12-13}$ and $C_{12-15}$ linear primary alcohol ethoxylates formed from 6.5 and 3 moles of ethylene oxide, respectively, have been found very useful in the present invention.

Neodol 45-13, a $C_{14-15}$ linear primary alcohol ethoxylate has also been found effective in the present invention. Another preferred nonionic surfactant is a group of compounds sold under the registered trademark of "Tergitol 15-S" manufactured by the Union Carbide Company. The "Tergitol 15-S" materials are mixtures of $C_{11-15}$ secondary alcohol condensed with 9–14 molar proportions of ethylene oxide.

The nonionic surfactants can be present in the free-flowing detergent composition in the amount of about 1% to about 50%. Of course the detergent benefits of high nonionic concentration must be balanced against cost-performance. Therefore, the preferred range for the nonionic surfactants is about 5% to about 30% by weight of the final product.

Although this invention is specifically and primarily directed to the inclusion of nonionic surfactants into detergent powders, other active materials known to the art may be incorporated in the detergent composition of this process. Several formulations which contain sodium alkylbenzene sulfonate or alkylbenzene sulfonic acid and mixtures thereof have been successfully processed by this method. Furthermore, any detergent ingredient which is fluid or which requires encapsulation to avoid caking and which is compatible with the process can be used with this method.

The finely divided metal carbonate salt may be chosen from sodium carbonate, potassium carbonate, calcium carbonate either independently or in combination with one another. These carbonates may be used in conjunction with detergent builders or can totally replace the detergent builders. A particularly preferred carbonate is calcium carbonate having the calcite structure with a particle diameter of about 0.025 microns and a surface area of approximately 50 meter$^2$/gram. Commercially, this calcium carbonate is available under the trademark of Calofort U50, manufactured by J & G Sturge Limited of Birmingham, England. The complete technical specifications for this finely divided calcite may be found in U.S. Pat. No. 3,957,695.

The criticality of carbonate particle size is illustrated by the calcium carbonate examples of Table I. Identical formulations were compounded varying only the type of calcium carbonate. Calofort U50 was compared with Calofort U and Durcal 40. Calofort U is also a trademark for a calcium carbonate manufactured by J & G Sturge Company. Durcal 40 is a trademark for a calcium carbonate sold by OMYA, Inc. of 61 Main St., Procter, Vt. These carbonates vary in their particle size and concommitantly in their surface area. Both Calofort U50 and Calofort U performed well as evidenced by their high dynamic flow rate (DFR). High DFR numbers (above 100) reflect good free-flowing properties. Durcal 40 was totally ineffective. The table demonstrates that small particle size and high surface area are critical to the effectiveness of the calcium carbonate. As extrapolated from Table I, a maximum particle size of about 20 microns and about 5–10 m$^2$/g surface area is necessary for practical application of this invention. Standard grades of calcium carbonate, such as Durcal 40, cannot meet the minimum specifications.

TABLE I

CARBONATE PARTICLE SIZE EFFECTS ON FREE-FLOW PROPERTIES

| | Mean Particle Diameter | Surface Area (meter$^2$/gram) | DFR |
|---|---|---|---|
| Calofort U50 | 250 Å (0.025 micron) | 50 | 142 |

TABLE I-continued

CARBONATE PARTICLE SIZE EFFECTS ON FREE-FLOW PROPERTIES

| | Mean Particle Diameter | Surface Area (meter$^2$/gram) | DFR |
|---|---|---|---|
| Calofort U | 400 Å (0.04 micron) | 30 | 138 |
| Durcal 40 | 40 micron | less than 1 | 0 |

A brief description of the dynamic flow rate apparatus and method follows: The apparatus has an open ended vertical tube approximately one inch in diameter and 25 inches in length. Markings on the upper and lower ends of the vertical tube describe a volume of 255 ml. The lower section of the tube is a 67° cone leading to an open end of $\frac{5}{8}$ inch diameter. To allow filling of the tube with powder the lower end is corked. In operation, the tube is completely filled with powder to the upper rim of the tube. The cork is removed. The length of time taken for the powder to pass between the upper and lower marks is measured. This measurement, known as the DFR, is reported as the volumetric flow rate in milliliters per second for the powder passing between the two marks.

Another particularly preferred carbonate is sodium carbonate derived by micropulverizing a standard grade of sodium carbonate, for example that provided by BASF Wyandotte Company of an average particle size of 165 microns. Micropulverization of the BASF Wyandotte standard sodium carbonate produces a finely divided powder of approximately 5 to 10 microns. The effectiveness of this micropulverized sodium carbonate is greatly increased.

Standard carbonate particles can be micropulverized to the optimum particle size in several ways. The best method is achieved by the use of a high pressure torroidal air mill such as the "Pulva Jet". Alnort Inc. of Willow Grove, Pa. manufactures this apparatus.

It has been discovered that there is an optimum ratio between standard sodium carbonate, employed as the detergent builder, and micropulverized sodium carbonate. This optimum ratio is apparently independent of the properties of the other raw material components. It is theorized that the mechanism is that of a seed particle (e.g. non-milled sodium carbonate) about which the active and micropulverized sodium carbonate are bound by the carboxylate structuring agent. The seed particle, in effect, acts as a pseudo catalyst for the interaction. Sodium sulfate and sodium citrate granules have been found useful as seed particles although they are not as effective as sodium carbonate for this purpose.

Optimum ratios have been determined from a number of experiments detailed in Examples 6–9. Ratios of finely divided, micropulverized sodium carbonate to standard sodium carbonate greater than 3:1 are preferred. The outer limits of that ratio should be no less than 1 to 3 of finely divided sodium carbonate to standard sodium carbonate where the amount of nonionic surfactant is present at about 20% or greater. Examples 29 through 34 give further evidence of this relationship.

Particle diameters for the finely divided carbonate salt component of the free-flowing detergent composition can vary from about 0.001 to about 300 microns. Particulary preferred are particles with diameters that range from 0.01 to 20 microns because of their free-flow inducing properties.

Finely divided metal carbonate salts may be present in the formulation in amounts of about 1% to about 80% by weight of final product. For calcium carbonate, the preferable range is about 5% to about 25% by weight of the final product. A preferred range for sodium carbonate is about 35% to about 75% by weight of the final product. Optimum cost-performance is achieved with these preferred ranges.

A number of factors will determine the optimum component concentrations in any particular formulation encompassed by the present invention. From an economic standpoint it is desirable to reduce the amount of polycarboxylic structuring agent within the composition, as these materials are the most expensive. Component concentrations are also dictated by the discovery that there exists an optimum ratio of the different carbonates to the different polycarboxylic structuring agents. These optimum concentrations are a function of the solid to liquid (e.g. builder/carbonate to nonionic) ratios in the formulation. Furthermore, variables such as the grade of the carbonate expressed in particle size, surface area and density are important factors. Molecular weights of the carboxylic copolymers as well as the physical characteristics of the nonionic actives and builder materials have also to be considered.

In addition to the aforementioned essential components, a finished detergent composition of this invention may include minor amounts of materials which enhance the product's attractiveness. The following are mentioned by way of examples. Peroxy-bleach agents along with their activators, suds-controlling agents and suds-boosters may be included. Minor ingredients such as anti-tarnishing agents, dyes, buffers, perfumes, anti-redeposition agents, colorants, and fluorescers are also frequently combined with this detergent composition.

In the process to prepare these detergent powders, the general method is first to thoroughly mix the substantially dry solid raw materials which include polycarboxylic structuring agent, detergent builder (other than finely divided metal carbonate) and finely divided metal carbonate salt. Thereafter, nonionic surfactant and sufficient water for dispersal of the structuring agent is applied to the above dry mixture. Besides use as a dispersant, the water can, if necessary, initiate neutralization of the polycarboxylic structuring agent. Neutralization occurs where the polycarboxylic structuring agent is either an acid or in the acid anhydride form. Excess water is then removed by a drying step.

In some instances it may be preferred to add the structuring agent in the wet step, rather than initially with the substantially dry solid raw materials mixture. Accordingly, in this process the structuring agent is simultaneously added with the nonionic surfactant and directly dispersed in the water. This particular method has a benefit with regard to particle size control. However, it has the drawbacks of difficult handling characteristics of the polymer solution, namely high viscosity and adhesion problems.

Another important aspect of the process is the inclusion of sufficient water for proper dispersion of polycarboxylic structuring agent and finely divided carbonate. About 4% to about 30% reaction water by weight of final product may be required in the liquid mixing step. It is desirable to employ the minimum amount of reaction water that is consistent with good dispersibility. By utilizing a minimum of water, less excess water needs to be removed in the drying step. Energy costs and time are thereby saved. Where micropulverized sodium carbonate is incorporated into the formulation as the finely divided carbonate salt, preferably about 5% to about 8% reaction water is needed for processing. Formulations incorporating calcium carbonate as the finely divided carbonate salt preferably require about 10% to about 20% reaction water for processing.

The mixing steps in the process to prepare detergent compositions of this invention are preferably accomplished with a high shear mixer. A Littleford Brothers Lodige FKM Mixing apparatus is an example of the preferred mixer. However, many mixers known in the art such as drum agglomerators, fluidized beds, pan agglomerators, etc. may be used. Generally, the mixing temperature can range around 70° F. to around 150° F. A temperature rise in the batch due to heat of reaction and mixing may at times necessitate a cooling mechanism. Batch temperatures higher than about 150° F. appear to adversely affect the product characteristics and are therefore undesirable.

Water removal may be accomplished in any unit designed for drying solid or granular materials. Drying temperatures, for removal of excess water, vary according to product formulation. The optimum drying temperature is established for each product formulation to avoid degradation and eliminate fire hazard. The preferred drying temperature range is around 200° F. to about 500° F.

Operation of the mixer and dryer is normally conducted at atmospheric pressure. Reduced pressure may be desirable in certain instances. For example, heat sensitive formulations are best dried under vacuum conditions. Vacuum processing shortens the residence time in the dryer. Equipment size requirements and lag time are thus reduced for heat sensitive formulations.

There are instances where drying may not be necessary. Certain materials such as sodium tripolyphosphate will bind water within a crystalline formation referred to as a hydrate. Relatively free-flowing product, despite high water content will result without the need for a drying operation. However, hydration and conditioning this type of formulation may require up to several hours. Heat drying requires less than one hour. It is a preferred embodiment of this process that a drying step be used. The reduction in lag time between mixing and final packaging is a desired benefit from the drying step.

Residual water remaining in the free-flowing detergent products can range from about 0% to about 20% by weight of final product. Preferably, the residual water content ranges from about 1% to about 5%. Where hydratable salts such as sodium tripolyphosphate are included within the composition, the residual water content could be as high as 20%.

The Examples that follow are merely presented as illustrative. Changes in the critical parameters can result in a dramatic variation in process/product requirements. All percentages, proportions and ratios herein and in the appended claims are by weight unless specified otherwise.

EXAMPLES 1-5

Illustrative of the free-flowing detergent compositions disclosed in this invention are those of Examples 1 through 5, as outlined in Table II. The examples of the table are typical of the formulations which may be produced by the present invention. Each of the formulation examples were processed in a Littleford Lodige FKX-120 batch mixer. Total mixing time was one minute. Wetted intermediate products were dried in a laboratory oven. Temperatures of about 180° F. were applied until a final moisture of about 3% was attained. Oversized particles were removed by screening through a U.S. 14 mesh sieve.

Free flow and powder cohesiveness was measured with a dynamic flow rate apparatus. A measurement referred to as the dynamic flow rate (DFR) is provided with the examples. Low numbers indicate poor flow. High numbers indicate good flow. Generally, a DFR of about 100–130 is considered to be adequate. Where the DFR is 130 or higher the powders have achieved optimum flow.

TABLE II

| Example No. | 1 | 2 | 3 | 4 | 5 |
|---|---|---|---|---|---|
| Sodium Carbonate[a] | 51.89 | 49.57 | 34.57 | 13.53 | — |
| Sodium Carbonate[b] | — | — | — | 40.59 | 62.51 |
| Sodium Citrate | 17.35 | 17.35 | 17.34 | 15.79 | 15.00 |
| Calcium Carbonate[c] | — | — | 17.34 | — | — |
| EMA-21[f] | 3.47 | 5.78 | 3.47 | 3.39 | — |
| Neodol 23-6.5 | 24.29 | 24.29 | 24.28 | 23.69 | 21.00 |
| Water[d] | 3.00 | 3.00 | 3.00 | 3.00 | 3.00 |
| Water[e] | 15.00 | 15.00 | 15.00 | 8.00 | 15.00 |
| DFR (ml/sec) | 100 | 135 | 150 | 142 | 69 |

[a]Sodium Carbonate provided by BASF Wyandotte Company - synthetic soda ash manufactured via Solvay process. Average particle size - 165 microns.
[b]Micropulverized (milled) sodium carbonate. Average particle size - approximately 5 to 10 microns.
[c]Calofort U50 - Calcium carbonate of a calcite structure with a particle diameter of about 0.025 microns and a surface area of approximately 50 $m^2/g$.
[d]Final water content after drying.
[e]Proportion of water - used to disperse, react, and agglomerate.
[f]EMA-21, Molecular Weight - 25,000. Full description may be found in Monsanto Technical Bulletin No. IC/FP-7.

Examples 3 and 4 of Table II demonstrate the beneficial effect of finely divided calcium and sodium carbonates, respectively. The dynamic flow rates of Examples 3 and 4 are 150 and 142, respectively. In comparison, the reference Example 1 exhibits a barely borderline adequate free flow (DFR of 100). Example 5 illustrates that finely divided sodium carbonate, alone, is ineffective, even when formulated in large amounts. Combinations of finely divided sodium carbonate with sufficient citrate or EMA-21 is essential for achieving free flowability. Larger amounts of EMA-21 can substitute for the finely divided metal carbonates, as in Example 2, but this solution is a costly alternative.

EXAMPLES 6–9

These examples detail the optimum ratio of standard sodium carbonate, employed as the detergent builder to finely divided, micropulverized sodium carbonate. Powder flowability is excellent in the formulations containing 3:1 to 1:1 ratios of micropulverized to standard sodium carbonate, Examples 7 and 8, with DFR values of 142 and 131, respectively. Example 9 containing a 1:3 ratio of micropulverized to standard sodium carbonate, outlines the lower limit of free-flow acceptablity; the DFR is 93. Formulations 29 and 30 of Table VIII containing slightly higher Neodol 23-6.5 (26.16%) and EMA-21 (4.65%) concentrations from those in Table III exhibit similar sensitivity toward sodium carbonate ratios. Examples 29 and 30 with micropulverized to standard sodium carbonate ratios of 1:3 and 3:1 display DFR values of 122 and 138, respectively.

TABLE III

| Ex. No. | % EMA-21 | % Neodol 23.6.5 | % Micro-pulverized Sodium Carbonate | % Standard Sodium Carbonate | Carbo-nate Ratio | DFR (ml/sec) |
|---|---|---|---|---|---|---|
| 6 | 1.97 | 21.13 | 76.9 | — | — | 138 |
| 7 | 1.97 | 21.13 | 57.68 | 19.23 | 3:1 | 142 |
| 8 | 1.97 | 21.13 | 38.45 | 38.45 | 1:1 | 131 |
| 9 | 1.97 | 21.13 | 19.23 | 57.68 | 1:3 | 93 |

EXAMPLES 10–11

Flowability of the products depend not only on the particular components in the system but also on establishing the proper proportion of each relative to another within system. Proper component ratios are illustrated by the example of calcium carbonate in the formulations of Examples 10 and 11 in Table IV. Use of an excess of calcium carbonate as with Calofort U in Example 10, results in a less crisp, less free flowing product. Comparison of the DFR in Examples 10 and 11 demonstrates the sensitivity of one component to another component.

TABLE IV

| Example No. | 10 | 11 |
|---|---|---|
| Calofort U (%) | 48.0 | 30.0 |
| Sodium Carbonate (%)[a] | — | 18.0 |
| EMA-21 (%) | 10.0 | 10.0 |
| Neodol 23-6.5 (%) | 40.0 | 40.0 |
| Water (after drying) (%) | 2.0 | 2.0 |
| Water (to react) (%) | 10.0 | 10.0 |
| DFR (ml/sec) | 116 | 131 |

[a]BASF Wyandotte, standard synthetic soda ash

EXAMPLES 12–14

Sufficient water must be used in mixing the nonionic surfactant with the polycarboxylic structuring agent-finely divided carbonate mixture. DFR values increase as the process water concentration increases from 3% to 5% to 8% in Examples 12, 13 and 14, respectively.

TABLE V

| Example No. | 12 | 13 | 14 |
|---|---|---|---|
| BASF Sodium Carbonate (%) | 27.06 | 27.06 | 27.06 |
| Micropulverized Sodium Carbonate (%) | 27.06 | 27.06 | 27.06 |
| Sodium Citrate (%) | 15.79 | 15.79 | 15.79 |
| EMA-21 (%) | 3.39 | 3.39 | 3.39 |
| Neodol 23-6.5 (%) | 23.69 | 23.69 | 23.69 |
| Water (final) (%) | 3.0 | 3.0 | 3.0 |
| Water (mix and reaction) (%) | 3.0 | 5.0 | 8.0 |
| DFR (after drying) | No flow | 117 | 138 |

"No flow" indicates the powder blocked the dynamic flow apparatus.

EXAMPLES 15–16

Citric acid and sodium citrate are shown to be effective structuring agents promoting good flow properties in Examples 15 and 16. The in situ neutralized citric acid formulation 16 has an especially high DFR of 142.

TABLE VI

| Example No. | 15 | 16 |
|---|---|---|
| BASF sodium carbonate (%) | 25.0 | — |
| Micropulverized sodium carbonate (%) | 50.0 | 62.0 |
| Sodium citrate (%) | — | 5.0 |
| EMA-21 (%) | — | 0.5 |
| Neodol 23-6.5 (%) | 20.0 | 22.5 |
| Citric acid[a] (%) | 5.0 | 10.0 |

TABLE VI-continued

| Example No. | 15 | 16 |
|---|---|---|
| (50% Solution) DFR (after drying) | 122 | 142 |

[a]Percentage based on the final reaction product (sodium citrate). Sodium hydroxide (50% solution) was employed in Example 15 for neutralization. An excess of sodium carbonate was used for neutralization in Example 16.

EXAMPLES 17–40

A number of formulations are presented in Tables VII and VIII to outline the scope of this invention. Various types of nonionic surfactant, including three each in the "Neodol" and "Tergitol" families, as seen in Examples 17–22, illustrate the applicability of this invention to a broad range of nonionic actives.

Sodium citrate and carbonate relationships are illustrated in Examples 23–24. The use of carboxymethyloxy succinic acid (CMOS) for these formulations is demonstrated by Examples 26–27. Examples 28–35 primarily delineate the acceptable amounts of standard and finely divided sodium carbonate components employed in these detergent compositions. Applications of citric acid in the compositions of this invention are described by Examples 37–40.

TABLE VII

| Example No. | 17 | 18 | 19 | 20 | 21 | 22 | 23 | 24 | 25 | 26 | 27 |
|---|---|---|---|---|---|---|---|---|---|---|---|
| Materials | | | | | | | | | | | |
| Sodium Carbonate(3) | 35.71 | 35.71 | 35.71 | 35.71 | 35.71 | 35.71 | — | 36.08 | 39.53 | 34.09 | — |
| Sodium Citrate | 17.86 | 17.86 | 17.86 | 17.86 | 17.86 | 17.86 | 42.74 | — | — | — | 13 |
| Calcium Carbonate(1) | 17.86 | 17.86 | 17.86 | 17.86 | 17.86 | 17.86 | 27.68 | 36.03 | 17.44 | 17.81 | 11.97 |
| CMOS(2) | — | — | — | — | — | — | 13 | — | — | 11.88 | 59.29 |
| Neodol 23-6.5 | 25.0 | — | 13 | — | — | — | 25.88 | 24.44 | 34.88 | 26.72 | 26.95 |
| Neodol 45-13 | — | 25.0 | — | 13 | 13 | — | — | — | — | — | — |
| Neodol 25-3 | — | — | 25.0 | — | — | — | — | — | — | — | — |
| Tergitol 15-S-9 | — | — | — | 25.0 | — | — | — | — | 13 | — | 13 |
| Tergitol 15-S-7 | — | — | — | — | 25.0 | — | — | — | — | — | — |
| Tergitol 15-S-3 | — | — | — | — | — | 25.0 | — | — | — | — | — |
| EMA-21 | 3.57 | 3.57 | 3.57 | 3.57 | 3.57 | 3.57 | 3.69 | 3.49 | 8.14 | 9.5 | 4.79 |
| Dynamic Flow Rate (ml/second) | 150 | 138 | 134 | 134 | 128 | 120 | 146 | 142 | 126 | 142 | 138 |

(1)Calofort U50.
(2)Carboxymethyloxy succinic acid - Supplied by Ethyl Corporation.
(3)BASF Wyandotte, standard synthetic soda ash.

TABLE VIII

| Example No. | 28 | 29 | 30 | 31 | 32 | 33 | 34 | 35 | 36 | 37 | 38 | 39 | 40 |
|---|---|---|---|---|---|---|---|---|---|---|---|---|---|
| Materials | | | | | | | | | | | | | |
| Sodium Carbonate(5) | — | 51.9 | 17.3 | 72.09 | 64.89 | 54.0 | 36.0 | — | 21.42(1) | — | 25.0 | — | — |
| Sodium Carbonate(2) | 76.9 | 17.3 | 51.89 | — | 7.2 | 18.0 | 36.0 | 74.42 | 42.84(3) | 75.0 | 50.0 | 56.55 | 56.95 |
| Sodium Citrate | — | — | — | — | — | — | — | — | — | — | — | 11.9 | 11.9 |
| Sodium Sulfate | — | — | — | — | — | — | — | — | 14.27 | — | — | — | — |
| Neodol 23-6.5 | 21.13 | 26.16 | 26.16 | 24.42 | 24.42 | 24.42 | 24.42 | 24.42 | — | 20.0 | 20.0 | 25.0 | 25.0 |
| Neodol 45-13 | — | — | — | — | — | — | — | — | 11.13 | — | — | — | — |
| CMEA(4) | — | — | — | — | — | — | — | — | 4.45 | — | — | — | — |
| Neodol 25-3 | — | — | — | — | — | — | — | — | 4.45 | — | — | — | — |
| EMA-21 | 1.97 | 4.65 | 4.65 | 3.49 | 3.49 | 3.49 | 3.49 | 1.16 | 1.42 | — | — | 0.6 | 0.2 |
| Citric Acid | — | — | — | — | — | — | — | — | — | 5.0 | 5.0 | 5.95 | 5.95 |
| Dynamic Flow Rate (ml/second) | 138 | 122 | 138 | 109 | 111 | 113 | 128 | 106 | 134 | 119 | 122 | 134 | 122 |

(1)FMC Grade 50.
(2)Micropulverized Sodium Carbonate average particle size approximately 5 microns.
(3)Stauffer Dense - Micropulverized to approximately 20 microns.
(4)Coco monoethanolamide.
(5)BASF Wyandotte, standard synthetic soda ash.

The foregoing description and examples illustrate selected embodiments of the present invention and in light thereof variations and modifications will be suggested to one skilled in the art, all of which are within the spirit and purview of this invention.

What is claimed is:

1. A free-flowing detergent composition comprising:
(a) a polycarboxylic structuring agent present in about 0.2% to about 50% by weight of final product;
(b) a finely divided sodium carbonate present in about 1% to about 80% by weight of final product, and having a mean particle diameter of 20 microns or less; and
(c) a nonionic surfactant present in about 1% to about 50% by weight of final product.

2. A free-flowing detergent composition in accordance with claim 1 wherein the polycarboxylic structuring agent is selected from the group consisting of ethylene-maleic anhydride copolymer, methyl vinyl ether-maleic anhydride copolymer, citric acid, nitrilotriacetic acid, ethylenediamine tetraacetic acid, carboxymethyloxy succinic acid and salts of said copolymers and acids and mixtures thereof.

3. A free-flowing detergent composition in accordance with claim 1 wherein the polycarboxylic structuring agent is ethylene-maleic anhydride copolymer having a molecular weight of about 10,000 to about 50,000.

4. A free-flowing detergent composition in accordance with claim 1 wherein the polycarboxylic structuring agent is ethylene-maleic anhydride copolymer present in an amount of about 0.2% to about 5% by weight of final product.

5. A free-flowing detergent composition in accordance with claim 1 wherein the polycarboxylic structuring agent is citric acid or sodium citrate present in about 5% to about 40% by weight of final product.

6. A free-flowing detergent composition in accordance with claim 1 wherein the polycarboxylic structuring agent is citric acid or sodium citrate present in about 5% to about 15% by weight of final product.

7. A free-flowing detergent composition in accordance with claim 1 wherein the polycarboxylic structuring agent is a combination of citrate and ethylene-maleic anhydride copolymer.

8. A free-flowing detergent composition in accordance with claim 1 wherein the polycarboxylic structuring agents have been neutralized in situ during the process to prepare said detergent composition.

9. A free-flowing detergent composition according to claim 1 wherein the polycarboxylic structuring agents have been neutralized prior to mixing with the other components.

10. A free-flowing detergent composition according to claim 1 wherein the finely divided sodium carbonate is present in about 35% to about 75% by weight of final product.

11. A free-flowing detergent composition in accordance with claim 1 having a detergent builder selected from the group consisting of sodium tripolyphosphate, sodium silicate, sodium carbonate, calcium carbonate, sodium citrate, and sodium aluminosilicate.

12. A free-flowing detergent composition according to claim 11 wherein the detergent builder is present in about 1% to about 98.8% by weight of final product.

13. A free-flowing detergent composition according to claim 11 wherein the detergent builder is present in about 50% to about 94.5% by weight of final product.

14. A free-flowing detergent composition according to claim 1 wherein finely divided sodium carbonate and standard detergent builder sodium carbonate are both present.

15. A free-flowing detergent composition according to claim 14 the ratio of finely divided sodium carbonate to standard detergent builder sodium carbonate is about 10:1 to about 1:3.

16. A free-flowing detergent composition in accordance with claim 14 wherein the ratio of finely divided sodium carbonate to standard detergent builder sodium carbonate is about 3:1 to about 1:3.

17. A free-flowing detergent composition in accordance with claim 1 wherein the nonionic surfactant is present in about 5% to about 30% by weight of the final product.

18. A process for manufacturing a free-flowing powdered detergent composition comprising:

(i) thoroughly mixing (a) a polycarboxylic structuring agent present in about 0.2% to about 50% by weight of final product;

(b) a finely divided alkali or alkaline earth metal carbonate and mixtures thereof present in about 1% to about 80% by weight of final product, and having a mean particle diameter of 20 microns or less; and (c) a detergent builder present in about 1% to about 98.8% by weight of final product;

(ii) subsequently applying to said mixture about 1% to about 30% of a nonionic surfactant and about 4% to about 30% of water for dispersal of the structuring agent and mixing together the total combination; and thereafter (iii) removing excess water.

19. A process for manufacturing a free-flowing powdered detergent composition comprising:

(i) thoroughly mixing (a) a finely divided alkali or alkaline earth metal carbonate and mixtures thereof present in about 1% to about 80% by weight of final product, and having a mean particle diameter of 20 microns or less; and (b) a detergent builder present in about 1% to about 98.8% by weight of final product;

(ii) subsequently applying to said mixture about 0.2% to about 50% of a polycarboxylic structuring agent, about 1% to about 50% of a nonionic surfactant and about 4% to about 30% of water for dispersal of the structuring agent and mixing together the total combination; and thereafter (iii) removing excess water.

20. A process in accordance with claim 18 or 19 wherein the mixing steps are performed with a high shear mixer.

21. A process in accordance with claim 18 or 19 wherein the temperature range for removal of excess water in step (iii) is about 200° F. to about 500° F.

22. A process in accordance with claim 18 or 19 wherein the water removal of step (iii) is accomplished under reduced pressure.

23. A process in accordance with claim 18 or 19 wherein excess water is removed by the detergent builder through chemical binding to form a crystalline hydrate.

24. A process in accordance with claim 18 or 19 wherein sodium carbonate is the finely divided metal carbonate and about 5% to about 8% water is used for dispersal.

25. A process in accordance with claim 18 or 19 wherein calcium carbonate is the finely divided metal carbonate and about 10% to about 20% water is used for dispersal.

26. A free-flowing detergent composition prepared by the process of claim 18 or 19 wherein the residual water content is about 1% to about 5%.

* * * * *